US009439484B2

(12) United States Patent
Nevatia

(10) Patent No.: US 9,439,484 B2
(45) Date of Patent: Sep. 13, 2016

(54) JEWELLERY WITH SECURELY NESTED CHANGEABLE DECORATIVE ELEMENTS

(71) Applicant: M/s. Sunjewels Pvt. Ltd., Mumbai (IN)

(72) Inventor: Shishir B Nevatia, Mumbai (IN)

( * ) Notice: Subject to any disclaimer, the term of this patent is extended or adjusted under 35 U.S.C. 154(b) by 192 days.

(21) Appl. No.: 14/466,962

(22) Filed: Aug. 23, 2014

(65) Prior Publication Data

US 2015/0320154 A1 Nov. 12, 2015

(30) Foreign Application Priority Data

May 8, 2014 (IN) ..... 1595/MUM/2014

(51) Int. Cl.

| | |
|---|---|
| ***A44C 13/00*** | (2006.01) |
| ***A44C 17/04*** | (2006.01) |
| ***A44C 17/02*** | (2006.01) |
| ***A44C 25/00*** | (2006.01) |
| ***A44B 5/00*** | (2006.01) |
| ***A44B 6/00*** | (2006.01) |
| ***A44C 1/00*** | (2006.01) |
| ***A44C 5/00*** | (2006.01) |
| ***A44C 11/00*** | (2006.01) |
| *A44C 9/00* | (2006.01) |

(52) U.S. Cl.

CPC ..... *A44C 17/0208* (2013.01); *A44B 5/00* (2013.01); *A44B 6/00* (2013.01); *A44C 1/00* (2013.01); *A44C 5/00* (2013.01); *A44C 11/00* (2013.01); *A44C 17/0216* (2013.01); *A44C 25/001* (2013.01); *A44C 9/00* (2013.01)

(58) Field of Classification Search

None

See application file for complete search history.

(56) References Cited

U.S. PATENT DOCUMENTS 1,371,131 A * 3/1921 Throop ..... A44B 5/02 24/102 SL
2,537,449 A * 1/1951 Evenson ..... A44C 17/0216 63/15

FOREIGN PATENT DOCUMENTS

DE 19635585 A1 * 3/1998 ..... A44C 17/0208

* cited by examiner

*Primary Examiner* — Jack W Lavinder

(57) ABSTRACT

A jewelry with securely nested changeable decorative elements having a main decorative element, optionally one or more auxiliary decorative element, securely fitted on a base ornament. The auxiliary decorative element, when present, is trapped between the main decorative element and the base ornament, the main decorative element and the optional auxiliary decorative element are securely nested and locked with the base ornament; and the main decorative element and the optional auxiliary decorative element get unlocked by a common action by a pointed tool. The main decorative element and auxiliary decorative element look integral to base ornament, that is, as if the jewelry is single piece jewelry.

12 Claims, 13 Drawing Sheets

JEWELLERY WITH SECURELY NESTED CHANGEABLE DECORATIVE ELEMENTS

FIELD OF INVENTION

The Present invention relates to jewelry. Particularly the invention relates to jewelry with decorative elements. More particularly, the invention relates to jewelry with one or more replaceable decorative elements.

BACKGROUND OF THE INVENTION

Jewellery with different and fresh looks and appeal is often the wish of the wearer of jewelry. The desired variety can be achieved by owning a number of jewelry items, for example, several different rings, and periodically changing the ring being worn. An alternative approach is to vary the appearance of a jewelry item by detachably connecting to the jewelry item an ornamental member which alters the appearance of the overall item.

The replaceability of decorative elements in jewelry articles such as rings, pendants, earrings, necklaces, bracelets and brooches is already known where precious stone or ornamental member can be fitted through some links or magnetic mechanism, such that the wearer can detach and re-fit different ornamental elements.

A number of concepts for attaching ornamental element to jewelry are available. In most instances, such arrangements deploy means where the ornamental element is attached and detached in apparent and direct manner whereby it is highly probable that the appearance gets impaired or whereby the detachment can happen inadvertently.

U.S. Pat. No. 4,488,415 describes jewelry with interchangeable stones. The base is provided with the lid which is further provided with the hook for locking, which securely holds stone against the bezel attached to the base of the ring. Presence of lid and lock may adversely impact the aesthetics of jewelry as well as there are chances that stone may fall if the lid gets opened inadvertently.

Another U.S. Pat. No. 5,165,257 describes a detachable mounting on the jewelry which comprises a button with a pin which can be attached to the piece of the jewelry. The jewelry comprises of side walls with perforations to allow pin to pass through it. Pin is attached to the button, thus the button can be interchanged accordingly. Such mechanism of the button and pin with locking also hinders the aesthetics of the jewelry.

Another Patent US 2012/0240623 A1 (Publication No.) describes magnetic interchangeable jewelry. The base of the jewelry consists of magnet dimensioned inside to hold the decorative cap portion of the jewelry. Such magnetic setting is not completely secure as the decorative cap may fall off.

Another U.S. Pat. No. 5,355,698 describes decorative jewelry ornament comprising of a setting with a decorative piece and coupler which is formed on the setting and fastener. The coupler is present on the setting as well as decorative piece used for engaging both of them. Absence of the locking mechanism makes the engagement setting weak as the decorative piece may fall anytime.

Therefore, there is need for replaceable jewelry design which provides a secure and redundant locking system and which does not impair the appearance of the ornament.

Further, our invention makes it possible to add more than one ornamental member in jewelry which normally have only one main decorative element; and thereby further alter richness as well as aesthetical appearance.

OBJECTIVE OF THE INVENTION

Objective of this invention is to provide simple yet reliable mechanism for the replaceable and modular part or parts of the jewelry.

Another objective of the invention is to provide the locking mechanism without affecting aesthetics of the jewelry.

Another objective is to invent a jewelry, which once fitted with replaceable decorative element(s), appears to be single piece jewelry.

Another objective is to invent a jewelry, which enables ease of replaceability of the decorative element the jewelry, providing a high degree of security once the replaceable ornamental portion is affixed to the base ornament.

Another objective is to invent a jewelry wherein the replaceable decorative element can be dislodged only with the aid of a tool.

Yet another objective is to invent a jewelry wherein more than one decorative element can be added to further the aesthetics and value of the jewelry.

Yet another objective is to invent a jewelry wherein one or more decorative elements are secured as well as removed by common action for all the decorative elements.

Yet Another objective of the invention is to provide the replaceability arrangement which can be deployed for different kinds of jewelry like ring, pendant, earring, bracelet, bangle, brooch & cuff links.

SUMMARY OF INVENTION

Our invention is a jewelry with securely nested changeable decorative element(s) where the decorative elements are of two types. The jewelry comprises at least one main decorative element and optionally one or more auxiliary decorative elements.

The main decorative element consists of a decorative surface and an integral shaft. The integral shaft of the main decorative element is generally made by a casting process. The integral shaft is shaped and dimensioned such as to be snuggly engage-able with the base ornament and give the appearance of single piece.

The integral shaft is substantially hollow and is provided with an arrangement to provide secured locking of main decorative element. The integral shaft comprises of a latch under an outward force by a spring. The assembly is such that the latch stays pushed out due to force of the spring. The latch has a curvature which facilitates easy negotiation with the receptacle of base ornament when the main decorative element is to be fitted into the base ornament. The latch has a tongue which is provided so as to engage with the key-hole and also so as to facilitate unlocking of the main decorative element.

The optional auxiliary decorative element has a peripheral decorative surface and a passage. The integral shaft of the main decorative element passes through the passage in the auxiliary decorative element. The auxiliary decorative element, when present, is trapped between the main decorative element and the base ornament. The auxiliary decorative element is shaped with respect to the main decorative element such that the main decorative element appears to be nested in the auxiliary decorative element.

The base ornament of the jewelry has a receptacle. The receptacle is essentially an opening, of shape and dimension which is compatible with the integral shaft so as to securely lock the main decorative element along with the auxiliary decorative element in the base ornament. A slant surface is provided on the inside of the receptacle which presses against the latch at its curvature so as to reduce the effort in pushing the main decorative element inside the receptacle of the base ornament. There is provided a key-hole on one face of the base ornament wherein the tongue of the latch slips in and thus gets securely locked when the main decorative element is pressed in the receptacle of the base ornament.

The passage of auxiliary decorative element comprises of a frame, a plurality of resilient links and a plurality of arms.

The resilient link is a thin metallic link provided on the inside of the frame diagonally and, correspondingly, on the base ornament are provided a plurality of grooves, such that when auxiliary decorative element is slightly pressed on the base ornament, the resilient link flexes and soon finds the groove and the resilient link sits in the groove. The arms are projected downwards and engulf the base ornament from the outside at a neck.

The auxiliary decorative element sits around the neck of the receptacle while the main decorative element sits on the top surface of the neck of the receptacle always.

The arms and the resilient link together helps in placement of auxiliary decorative element on the base ornament so that the auxiliary element occupies the location commensurate to receive the main decorative element thereon without the wearer needing to pay any attention to the auxiliary decorative element while assembling the main decorative element.

The auxiliary decorative element can be intuitively placed on the base ornament without any skill and instruction. When auxiliary decorative element is slightly pressed on the base ornament, the resilient link flexes and soon finds the groove and the resilient link sits on the groove. Thereafter, as the main decorative element is slightly pressed, the slant surface provided on the inside of the receptacle presses the latch at its curvature so as to reduce the effort in pushing the main decorative element inside the receptacle of the base ornament. The tongue of the latch slips in the key-hole and the main decorative element thus gets nested in the auxiliary decorative element and also gets securely locked with the base ornament. In turn, the auxiliary decorative element is also securely locked.

The key-hole in the base ornament is dimensioned to receive a pointed tool, besides the tongue of the latch. The pointed tool is insertable below the tongue of the latch. The wearer can see the tongue from the key-hole and therefore has no difficulty in just pushing the pointed tool there below. As the wearer inserts the pointed tool in the key-hole and thereby applies a minimal force $F_d$, the pointed tool interacts with a curvature of the latch such that the force $F_d$ results into bi-directional force—Horizontal force $F_h$ and Vertical Force $F_v$. The horizontal force $F_h$ pushes back the tongue of the latch and as soon as the latch is freed from the key-hole, the Vertical Force $F_v$ lifts up the latch and thereby the main decorative element. Consequently, both, the main decorative element and the auxiliary decorative element get unlocked by a common action. For further lifting up the main decorative element and the auxiliary decorative element, the user may incline the pointed tool.

As another embodiment, the placement of the auxiliary decorative element can be also achieved by providing biased construction on the inside of the base ornament, on the outside of the frame of the auxiliary element and on the outside of the integral shaft of the main decorative element. One such biased construction is dove tail arrangement. The dovetail arrangement is a known arrangement wherein a projected profile of the shape of a tail of a dove is engaged with the corresponding hollow profile of the shape termed here as dove channel. The base ornament and the main decorative element have the construction of a dove channel while the auxiliary decorative element has the construction of a dove tail of compatible dimensions.

The dove tail on auxiliary decorative element is engaged with the dove channel of base ornament placed so that the auxiliary decorative element occupies the location commensurate to receive the main decorative element thereon without the wearer needing to pay any attention to the auxiliary decorative element while assembling the main decorative element.

The auxiliary decorative element sits on the top surface of the neck of the receptacle while the main decorative element sits on the top surface of the auxiliary decorative element. If the auxiliary decorative element is absent, then in this embodiment, the main decorative element sits on the top surface of the neck of the receptacle.

Consequent to change in the location of the main decorative element depending on whether the auxiliary decorative element is present or absent, two locking positions are provided in the receptacle in this embodiment.

DETAILED DESCRIPTION OF INVENTION

The preferred embodiment of jewelry as per our invention will now be described in detail, with reference to the accompanying drawings. The terms and expressions which have been used here are merely for description but the invention can be worked with several variations and the terms and expressions should not be construed to be limiting the invention in any way.

The invention is described with the embodiment of a finger ring; however, the jewelry could be a bracelet, a locket, a pendant, an earring, a cufflink, a nose pin or any other ornament.

Our invention is a jewelry (1) with securely nested changeable decorative element(s) (2, 5) where the decorative elements are of two types—main decorative element (2) and auxiliary decorative element (5). Jewellery (1) comprises at least one main decorative element (2) and optionally one or more auxiliary decorative elements (5). In other words, the jewelry (1) CANNOT be used without main decorative element (2) with only auxiliary decorative element (5). Also, the same jewelry is complete in both versions—with auxiliary decorative element and without auxiliary decorative element.

The term "securely nested" is used to convey the unique aspect of the invention wherein the auxiliary decorative element has a "welcoming warmth and additional completeness" in the shape that it partially surrounds the decorative element, analogous to a nest surrounding the eggs with notional security and protection. However, the term should not be misconstrued to limit the scope of this invention.

Figure 1:
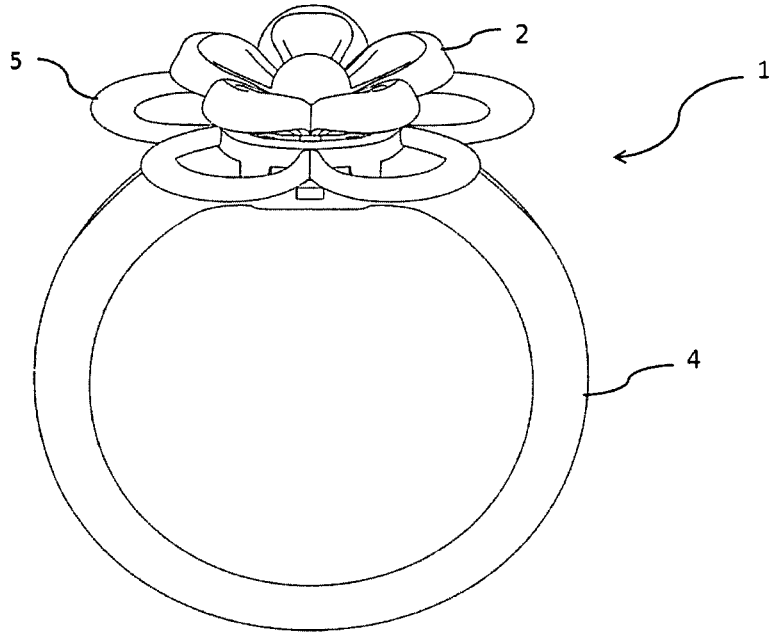
FIGS. 1 and 1A show a jewelry in the form of a ring, as it appears when it is ready to wear.

FIG. 1 shows the jewelry (1) in the shape of a finger ring. Here, the main decorative element (2) and auxiliary decorative element (5) look integral to base ornament (4), that is, as if the jewelry (1) is single piece jewelry.

Figure 1A:
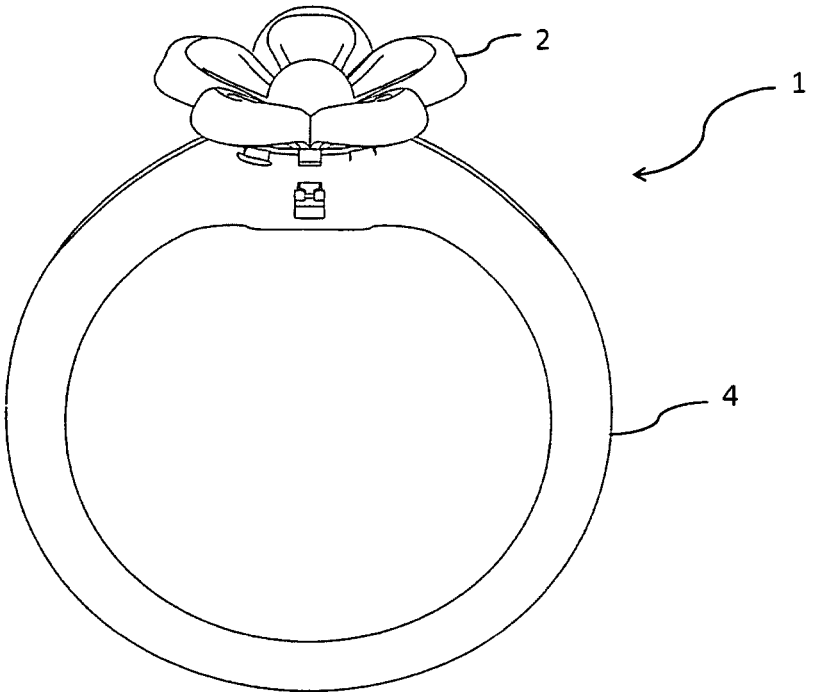

The jewelry (1) can be also provided without the auxiliary decorative element (5) where the main decorative element (2) looks integral to the base ornament (4) to give jewelry (1) an appearance of single piece jewelry as shown in FIG. 1A.

Figure 2:
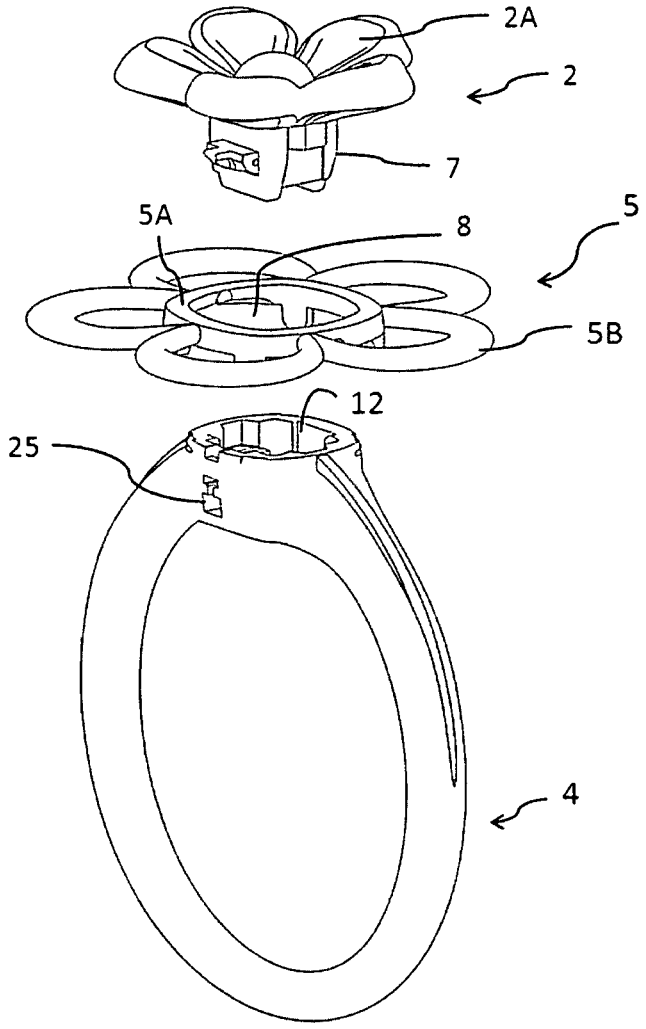
FIG. 2 shows the decorative element(s) and the base ornament of the jewelry in the form of the ring, when separated.

FIG. 2 discloses the main decorative element (2), the auxiliary decorative element (5) and the base element (4) when separated. The main decorative element (2) consists of a decorative surface (2A) and an integral shaft (7).

The decorative surface (2A) can be with any aesthetical construction and shape, with or without studding of precious stones. The integral shaft (7) of the main decorative element (2) is generally made by a casting process. The integral shaft (7) is shaped and dimensioned such as to be snuggly engage-able with the base ornament (4) and give the appearance of single piece jewelry (1) as shown in FIG. 1.

Figure 3:
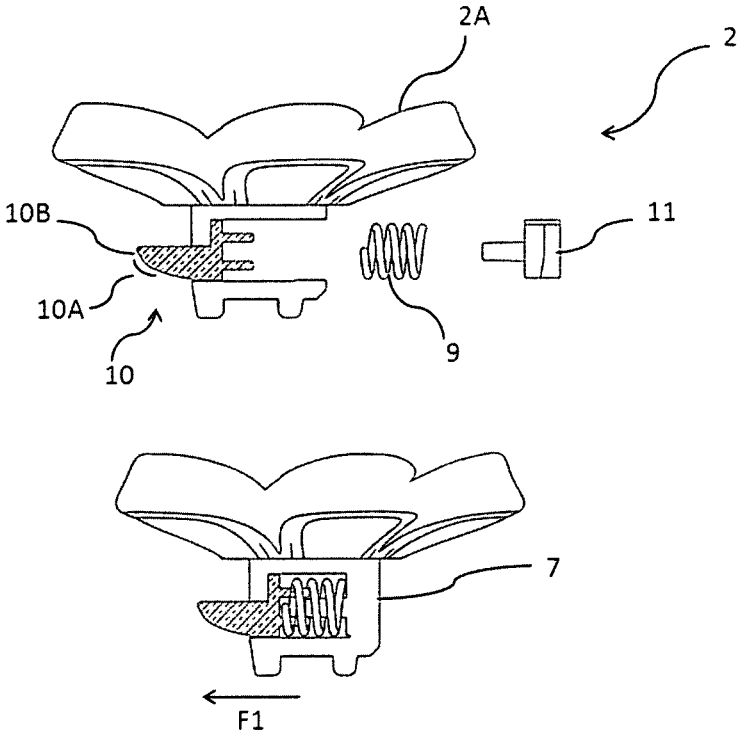
FIG. 3 shows parts of the main decorative element when dis-assembled; and when assembled.

The integral shaft (7) of the main decorative element (2) is substantially hollow and is provided with an arrangement to provide secured locking of main decorative element (2) as shown in FIG. 3. The integral shaft (7) comprises of a latch (10), under an outward force $F_l$ by a spring (9). The latch (10) is permanently assembled in the integral shaft (7) by inserting it from inside the integral shaft (7). A spring (9) is provided behind the latch (10) which is located by an anchor pin (11). The anchor pin (11) supports and holds the spring (9) in a slightly compressed state, so that the latch (10) is always under the outward force $F_l$ by the spring (9). The anchor pin (11) is secured in the place by known processes.

The latch (10) has a curvature (10A) which facilitates easy negotiation with the receptacle (12) of base ornament (4) when the main decorative element (2) is to be fitted into the base ornament (4), which is described later. The latch (10) has a tongue (10B) which is provided so as to engage with the key-hole (25) and also so as to facilitate unlocking of the main decorative element (2), also described later.

Figure 4:
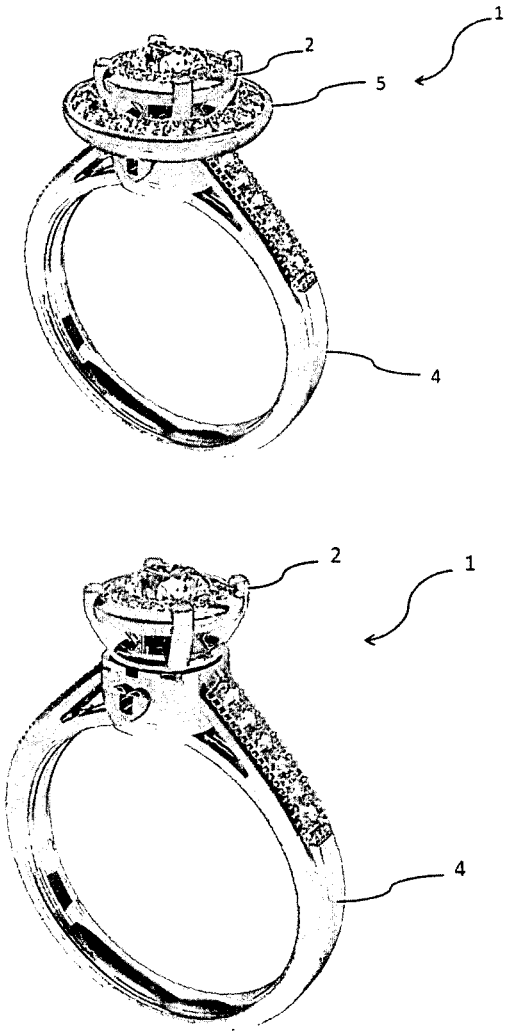
FIG. 4 illustrates a jewelry with only main decorative element, as also with main as well as auxiliary decorative element, to exhibit the nested aspect.
Figure 5:
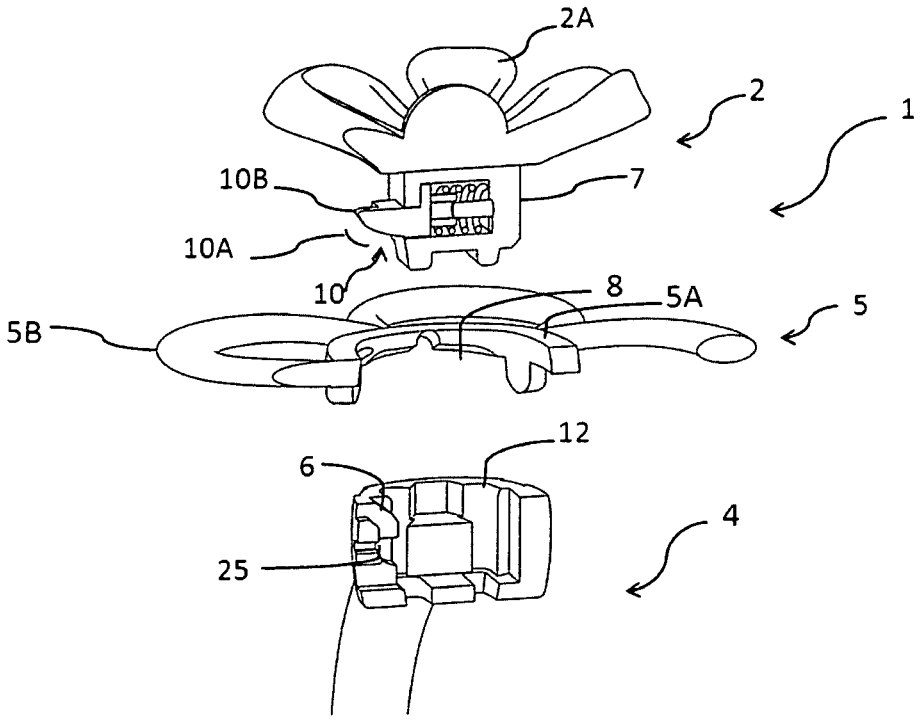
FIG. 5 shows the constructional details of the jewelry

The optional auxiliary decorative element (5) has a peripheral decorative surface (5B) and a passage (8). The integral shaft (7) of the main decorative element (2) passes through the passage (8) in the auxiliary decorative element (5). The auxiliary decorative element (5), when present, is trapped between the main decorative element (2) and the base ornament (4). The auxiliary decorative element (5) is shaped with respect to the main decorative element (2) such that the main decorative element (2) appears to be nested in the auxiliary decorative element (5) as shown in FIG. 4.

The base ornament (4) of the jewelry (1) has a receptacle (12). The receptacle (12) is essentially an opening, of shape and dimension which is compatible with the integral shaft (7) so as to securely lock the main decorative element (2) along with the auxiliary decorative element (5) in the base ornament (4). A slant surface (6) is provided on the inside of the receptacle (12) which presses against the latch (10) at its curvature (10A) so as to reduce the effort in pushing the main decorative element (2) inside the receptacle (12) of the base ornament (4). There is provided a key-hole (25) on one face of the base ornament (4) wherein the tongue (10B) of the latch slips in and thus gets securely locked when the main decorative element (2) is pressed in the receptacle of the base ornament (4).

Figure 6:
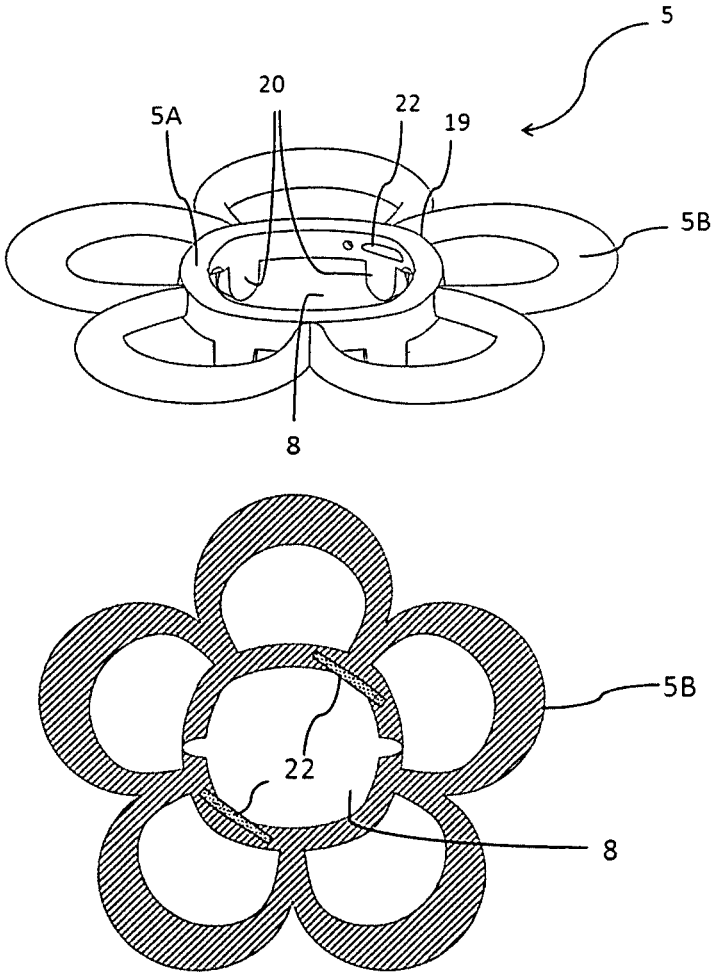
FIG. 6 shows the perspective and back sectional view of the auxiliary decorative element giving details of frame, arm and resilient link.

The passage (8) of auxiliary decorative element (5) comprises of a frame (19), a plurality of resilient links (22) and a plurality of arms (20) shown in FIG. 6.

The resilient link (22) is a thin metallic link provided on the inside of the frame (19) diagonally and, correspondingly, on the base ornament (4) are provided a plurality of grooves (24), such that when auxiliary decorative element (5) is slightly pressed on the base ornament (2), the resilient link (22) flexes and soon finds the groove (24) and the resilient link (22) sits in the groove (24).

The arms (20) are projected downwards and engulf the base ornament (4) from the outside at the neck (3) of the base ornament (4).

The auxiliary decorative element (5) sits around the neck (3) of the receptacle (12) while the main decorative element sits on the top surface (3A) of the neck (3) of the receptacle (12) always.

Figure 7:
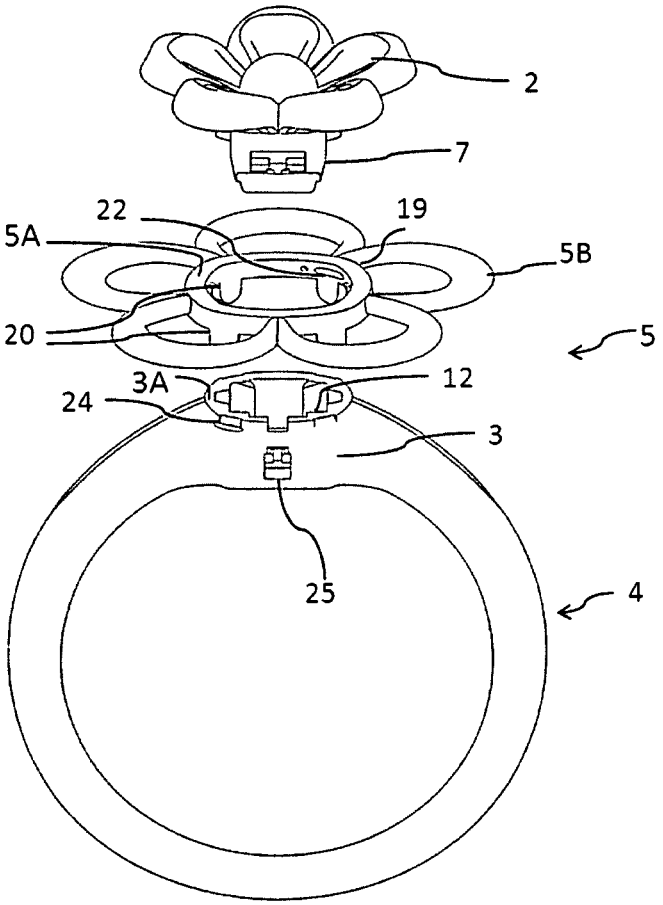
FIG. 7 shows the details of the receptacle of the base ornament showing key-hole and grooves, and also related details of the decorative element(s).

The arms (20) and the resilient link (22) together facilitate placement of auxiliary decorative element (5) on the base ornament (4) so that the auxiliary element occupies the location commensurate to receive the main decorative element (2) thereon without the wearer needing to pay any attention to the auxiliary decorative element (5) while assembling the main decorative element (2) as shown in FIG. 7.

Figure 8:
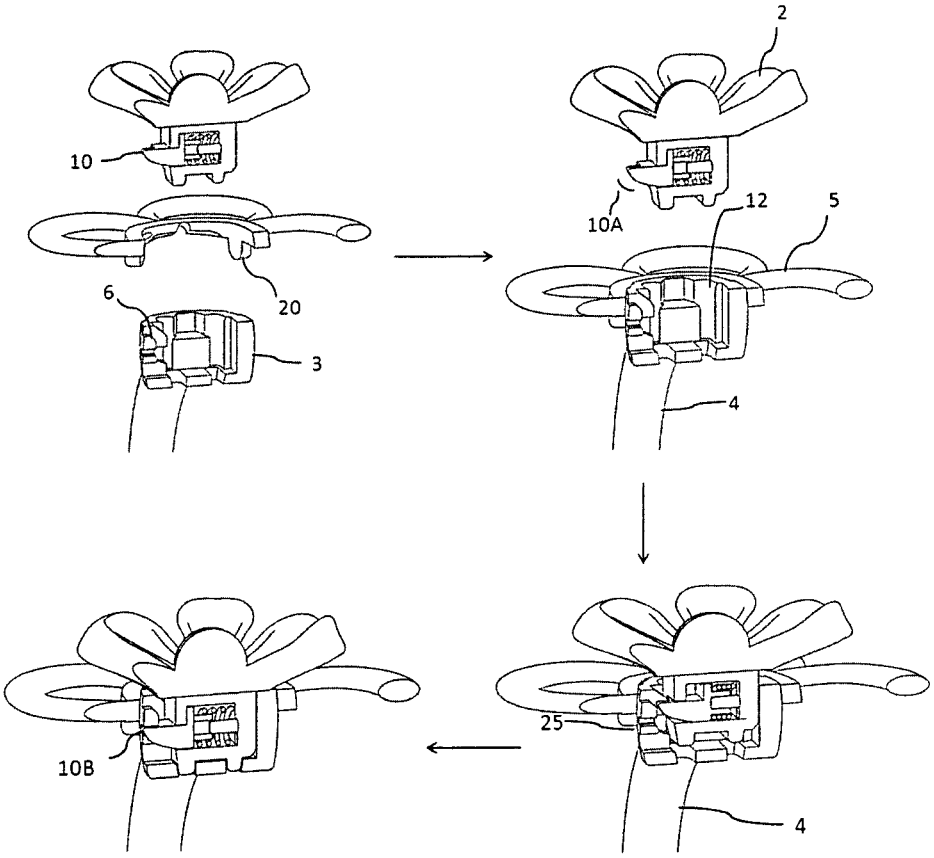
FIG. 8 describes the stepwise engagement and locking of the decorative element(s) with the base ornament.

FIG. 8 shows the step wise assembly of the auxiliary decorative element (5) along with the main decorative element (2) with the base ornament (4), which can be understood by also referring to FIG. 7 along with FIG. 8.

The auxiliary decorative element (5) can be intuitively placed on the base ornament (4) without any skill and instruction. When auxiliary decorative element (5) is slightly pressed on the base ornament (2), the resilient link (22) flexes and soon finds the groove (24) and the resilient link (22) sits on the groove (24). The arms (20) engulf the base ornament from the outside at the neck (3) of the base decorative element (4).

Thereafter, as the main decorative element is slightly pressed, the slant surface (6) provided on the inside of the receptacle (12) presses the latch (10) at its curvature (10A) so as to reduce the effort in pushing the main decorative element (2) inside the receptacle (12) of the base ornament (4). The tongue (10B) of the latch (10) slips in the key hole (25) and the main decorative element (2) thus gets nested in the auxiliary decorative element (5) and also gets securely locked with the base ornament (4). In turn, the auxiliary decorative element (5) is also securely locked.

Figure 9:
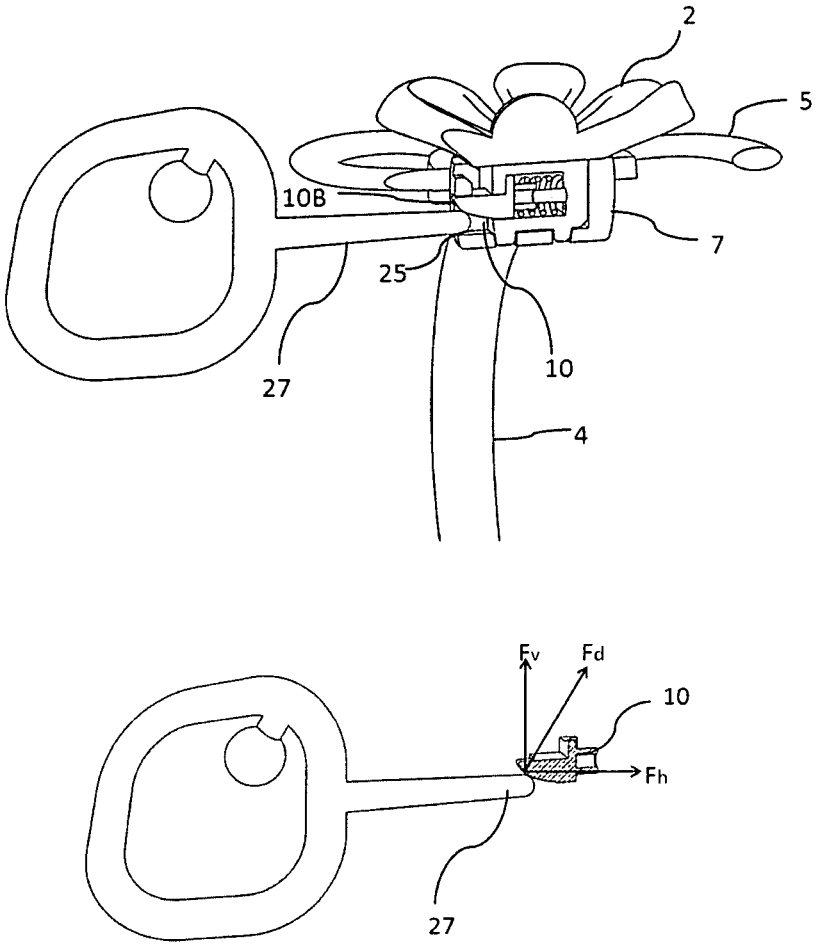
FIG. 9 describes the process of unlocking of the decorative elements(s) from the base ornament.

FIG. 9 shows unlocking of main as well as auxiliary decorative elements by a common action.

Figure 9A:
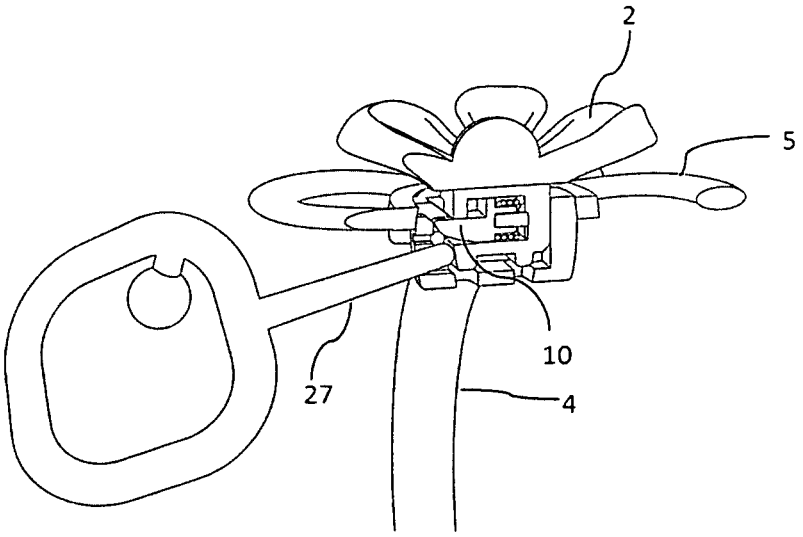
FIG. 9A shows the pointed tool at an inclination.

The key-hole (25) in the base element (4) is dimensioned to receive a pointed tool (27), besides the tongue (10B) of the latch (10). The pointed tool (27) is insertable below the tongue (10B) of the latch (10). The wearer can see the tongue (10B) from the key-hole (25) and therefore has no difficulty in just pushing the pointed tool (27) there below. As the wearer inserts the pointed tool (27) in the key hole (25) and thereby applies a minimal force $F_d$, the pointed tool (27) interacts with a curvature (10A) of the latch (10) such that the force $F_d$results into bi-directional force —Horizontal force $F_h$, and Vertical force $F_v$. The horizontal force $F_h$pushes back the tongue (10B) of the latch (10) and as soon as the latch is freed from the key-hole (25), the Vertical Force $F_v$ lifts up the latch (10) and thereby the main decorative element (2). Consequently, both, the main decorative element and the auxiliary decorative element get unlocked by a common action. For further lifting up the main decorative element (2) and the auxiliary decorative element (5), the user may incline the pointed tool (27) as shown in FIG. 9A.

Figure 6A:
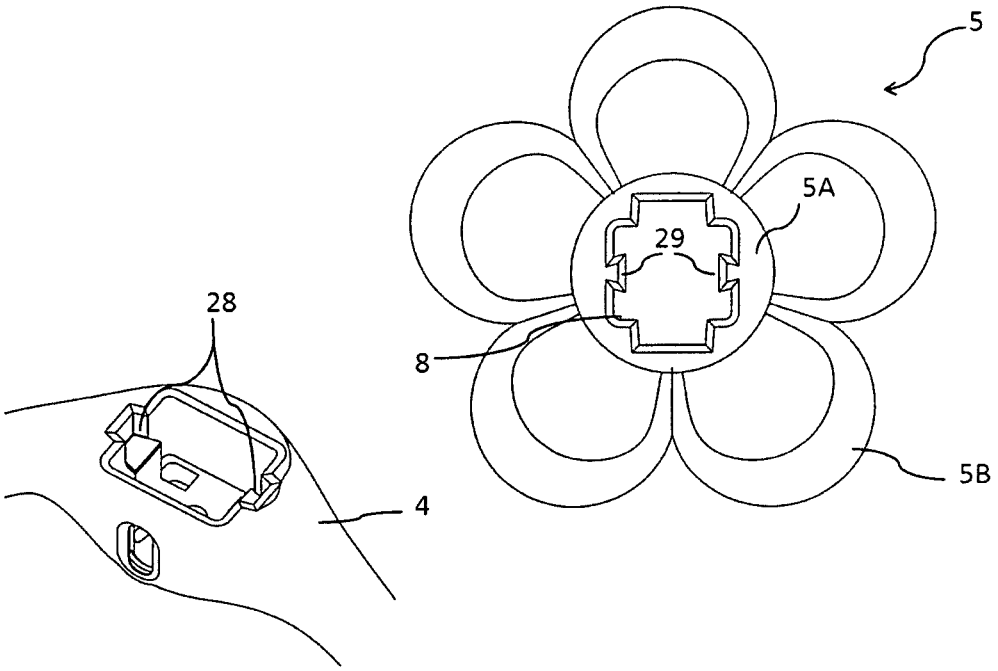
FIG. 6A shows the top view of another variation of a auxiliary decorative element with dove tail, and a corresponding main decorative element with dove channel.

As another embodiment, the placement of the auxiliary decorative element (5) can be also achieved by providing biased construction on the inside of the base ornament (4), on the outside of the frame of the auxiliary element (5) and on the outside of the integral shaft (7) of the main decorative element (2). One such biased construction is dove tail arrangement. The dovetail arrangement is a known arrangement wherein a projected profile of the shape of a tail of a dove is engaged with the corresponding hollow profile of the shape termed here as dove channel (28). The base ornament (4) and the main decorative element (2) have the construction of a dove channel (28) while the auxiliary decorative element has the construction of a dove tail (29) of compatible dimensions, as shown in FIG. 6A.

The dove tail (29) on auxiliary decorative element (5) is engaged with the dove channel (28) of base ornament (4) placed so that the auxiliary decorative element (5) occupies the location commensurate to receive the main decorative element (2) thereon without the wearer needing to pay any attention to the auxiliary decorative element (5) while assembling the main decorative element (2).

The auxiliary decorative element sits on the top surface (3A) of the neck (3) of the receptacle (12) while the main decorative element sits on the top surface (5A) of the auxiliary decorative element (5). If the auxiliary decorative element is absent, then in this embodiment, the main decorative element sits on the top surface (3A) of the neck (3) of the receptacle (12).

Figure 10:
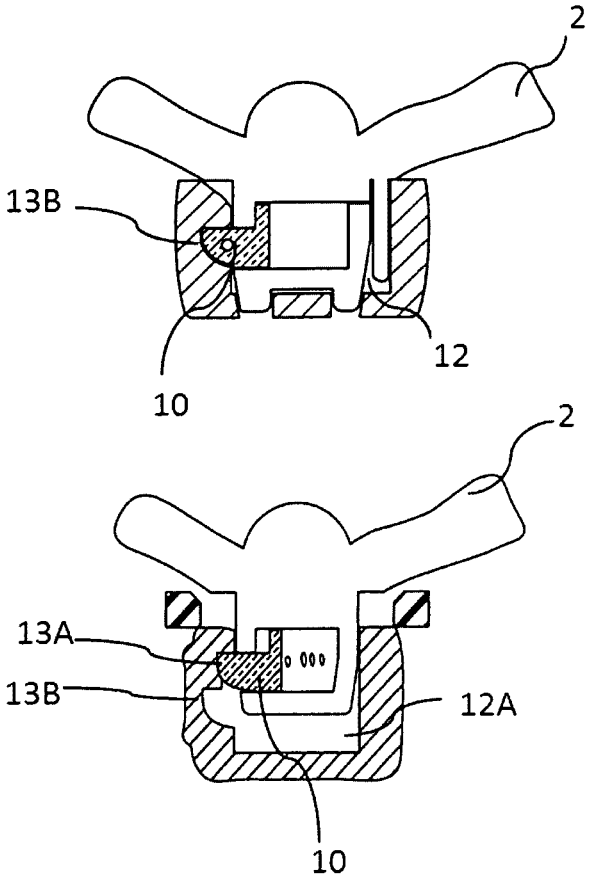
FIG. 10 shows two locking positions provided in the receptacle

Consequent to change in the location of the main decorative element (2) depending on whether the auxiliary decorative element (5) is present or absent, two locking positions are provided in the receptacle (12A) in this embodiment. FIG. 10 shows two locking positions (13A) and (13B). When there is no auxiliary decorative element (5) present, the main decorative element is locked in a locking position (13B), else in a locking position (13A).

In all cases, the decorative elements cannot get removed inadvertently nor by malafide intention, unless some pointed is object used as described. In other words, the mechanism of attaching and detaching the decorative elements is reliable and with high degree of security.

In all cases, when the auxiliary decorative element(s) is not present, the assembly/attaching/locking and disassembly/detaching/unlocking of the main decorative element is done with the base ornament in the same manner by the wearer excluding the steps related to auxiliary decorative element.

I claim:

1. A jewelry with changeable decorative elements comprising of:

a. a main decorative element having an integral shaft, a tongue on a latch under outward force by a spring provided in the integral shaft, and a decorative surface;

b. one or more auxiliary decorative element having a peripheral decorative surface and a passage; and c. a base ornament with a receptacle having a neck, a top surface of the neck, and a key-hole, the key-hole is dimensioned to receive a pointed tool besides the tongue of the latch, the auxiliary decorative element trapped between the main decorative element and the base ornament; the passage of the auxiliary decorative element is provided with a plurality of resilient links and the receptacle of the base ornament is provided with a plurality of grooves such that the plurality of resilient links flexes and finds the plurality of grooves on the receptacle, the plurality of resilient link sits in the plurality of grooves when the auxiliary decorative element is slightly pressed on the base ornament; the main decorative element and the auxiliary decorative element securely nested and locked with the base ornament; and the main decorative element and the auxiliary decorative element getting unlocked by a common action by a pointed tool, the pointed tool insertible below the tongue of the latch, the pointed tool interacts with a curvature of the latch such that a force $F_d$ by the pointed tool on the tongue of the latch results into bi-directional force- a Horizontal force $F_h$ and a Vertical Force $F_v$ the horizontal force $F_h$ pushes back the tongue of the latch and as soon as the latch is freed from the key-hole the Vertical Force $F_v$ lifts up the latch and thereby the main decorative element, a user may incline the pointed tool.

2. The jewelry with changeable decorative elements as claimed in claim 1, wherein the passage of the auxiliary decorative element is provided with a plurality of arms such that the plurality of arms engulf the base ornament from an outside of the neck of the base ornament, when the auxiliary decorative element is slightly pressed on the base ornament.

3. The jewelry with changeable decorative elements as claimed in claim 1, wherein the auxiliary decorative element sits around the neck of the receptacle while the main decorative element sits on the top surface of the neck of the receptacle.

4. The jewelry with changeable decorative elements as claimed in claim 1, wherein the auxiliary decorative element has a dove tail.

5. A jewelry with changeable decorative elements comprising of:

a. a main decorative element having an integral shaft, a tongue on a latch under outward force by a spring provided in the integral shaft, and a decorative surface;

b. abase ornament with a receptacle having a neck, a top surface of the neck, and a key-hole, the key-hole is dimensioned to receive a pointed tool besides the tongue of the latch, the main decorative element securely locked with the base ornament; and the main decorative element getting unlocked by a common action by the pointed tool, the pointed tool insertible below the tongue of the latch, the pointed tool interacts with a curvature of the latch such that a force $F_d$ by the pointed tool on the tongue of the latch results into bi-directional force—a Horizontal force $F_h$, and a Vertical Force $F_v$, the horizontal force $F_h$ pushes back the tongue of the latch and as soon as the latch is freed from the key-hole, the Vertical Force $F_v$ lifts up the latch and thereby the main decorative element, a user may incline the pointed tool.

6. The jewelry with changeable decorative elements as claimed in claim 1, wherein the auxiliary decorative element sits on the top surface of the neck of the receptacle while the main decorative element sits on a top surface of the auxiliary decorative element.

7. The jewelry with changeable decorative elements as claimed in claim 1 or 5, wherein the base ornament is provided with one or more locking positions.

8. The jewelry with changeable decorative elements as claimed in claim 1 or 5, wherein the main decorative element and the auxiliary decorative elements are of different nested shape and precious metal.

9. The jewelry as claimed in claim 1 or 5, wherein said jewelry is a ring, an earring, a pendant, a brooch, a bracelet, a chain, a bangle, a cufflink, a necktie clip or a piercing stud, etc.

10. The jewelry with changeable decorative elements as claimed in claim 1 or 5, wherein the main decorative element and the base ornament have a dove channel.

11. The jewelry with changeable decorative elements as claimed in claim 1 or 5, wherein the receptacle is provided with a slant surface on an inside of the receptacle such that the slant presses the latch at a curvature and the tongue of the latch slips in the key-hole as the main decorative element is slightly pressed on the base ornament.

12. The jewelry with changeable decorative elements as claimed in claim 5, wherein the main decorative element sits on the top surface of the neck of the receptacle.

* * * * *